US008375753B2

(12) United States Patent
Goldman

(10) Patent No.: US 8,375,753 B2
(45) Date of Patent: Feb. 19, 2013

(54) SOLENOID-OPERATED ELECTROMECHANICAL LOCK

(75) Inventor: Ilan Goldman, Herzliya (IL)

(73) Assignee: Knock N'Lock Ltd., Yokneam (IL)

( * ) Notice: Subject to any disclaimer, the term of this patent is extended or adjusted under 35 U.S.C. 154(b) by 519 days.

(21) Appl. No.: 12/449,356

(22) PCT Filed: Feb. 6, 2008

(86) PCT No.: PCT/IL2008/000160

§ 371 (c)(1),
(2), (4) Date: Aug. 4, 2009

(87) PCT Pub. No.: WO2008/096355

PCT Pub. Date: Aug. 14, 2008

(65) Prior Publication Data

US 2009/0308117 A1 Dec. 17, 2009

Related U.S. Application Data

(60) Provisional application No. 60/900,101, filed on Feb. 8, 2007.

(51) Int. Cl.
*E05B 47/06* (2006.01)

(52) U.S. Cl. ..... 70/277; 70/278.7; 70/279.1; 70/283

(58) Field of Classification Search ..... 70/277, 70/278.7, 279.1, 283; 292/144
See application file for complete search history.

(56) References Cited

U.S. PATENT DOCUMENTS

| | | | | |
|---|---|---|---|---|
| 4,730,471 | A * | 3/1988 | Seckinger et al. | 70/277 |
| 4,745,785 | A * | 5/1988 | Uebersax | 70/279.1 |
| 4,807,454 | A * | 2/1989 | Sengupta et al. | 70/277 |
| 5,216,909 | A * | 6/1993 | Armoogam | 70/278.7 |
| 5,307,656 | A | 5/1994 | Gartner et al. | |
| 5,339,662 | A | 8/1994 | Goldman | |
| 5,960,656 | A * | 10/1999 | Yao | 70/472 |
| 6,286,347 | B1 * | 9/2001 | Frolov | 70/472 |
| 6,411,195 | B1 | 6/2002 | Goldman | |

(Continued)

FOREIGN PATENT DOCUMENTS

| | | | |
|---|---|---|---|
| DE | 297 03 758 | U1 | 7/1997 |
| DE | 197 27 422 | C1 | 6/1998 |
| EP | 0 794 540 | A1 | 9/1997 |
| EP | 0 999 328 | A1 | 5/2000 |

(Continued)

*Primary Examiner* — Lloyd Gall
(74) *Attorney, Agent, or Firm* — Vorys, Sater, Seymour and Pease LLP; Susanne M. Hopkins; William L. Klima

(57) ABSTRACT

An electromechanical lock is provided that comprises a locking assembly and a latch solenoid with a plunger axially displaceable, by an electrical command signal, between retracted and extended states and being associated with a first urging arrangement that biases the plunger in a first axial direction from the retracted to the extended states. The locking assembly comprises a lock actuation member movable between first and second states for locking and unlocking the lock, respectively. A second urging arrangement is operative to bias the actuation member to move to the second state. A third urging arrangement is operative to bias the actuation member to move from the second to the first state. The plunger is operatively associated with the locking assembly to cause the lock actuation member to move from the first to the second state for unlocking the lock upon displacement of the plunger in the first direction, and to permit movement of the actuation member, induced by the third urging arrangement, from the second to the first state for locking the lock, upon displacement of the plunger from the extended to the retraced state.

13 Claims, 10 Drawing Sheets

U.S. PATENT DOCUMENTS

| | | | | |
|---|---|---|---|---|
| 6,581,423 | B2 * | 6/2003 | Lin | 70/107 |
| 6,677,844 | B1 * | 1/2004 | Gorospe et al. | 335/220 |
| 6,865,916 | B2 | 3/2005 | Goldman | |
| 6,892,557 | B2 * | 5/2005 | Bieniek | 70/278.7 |
| 7,784,315 | B2 * | 8/2010 | Yang | 70/279.1 |
| 2001/0027671 | A1 | 10/2001 | Davis | |
| 2004/0025551 | A1 * | 2/2004 | Bieniek | 70/278.3 |
| 2006/0179903 | A1 | 8/2006 | Goldman | |

FOREIGN PATENT DOCUMENTS

| | | | |
|---|---|---|---|
| EP | 1 039 072 | A2 | 9/2000 |
| WO | 97/48867 | A1 | 12/1997 |
| WO | 99/61728 | A1 | 12/1999 |
| WO | 2004/020767 | A1 | 3/2004 |
| WO | 2004/079136 | A1 | 9/2004 |

* cited by examiner

SOLENOID-OPERATED ELECTROMECHANICAL LOCK

This is a National Phase Application filed under 35 U.S.C. 371 as a national stage of PCT/IL2008/000160, filed on Feb. 6, 2008, an application claiming the benefit under 35 U.S.C. 119(e) of U.S. Provisional Application No. 60/900,101, filed on Feb. 8, 2007, the entire content of each of which is hereby incorporated by reference in its entirety.

FIELD OF THE INVENTION

This invention relates to an electromechanical lock with a novel locking assembly.

BACKGROUND OF THE INVENTION

Electronic locks use an electrical servomechanism to reversibly block locking or unlocking. In some locks, the plunger of the solenoid functions as the bolt or latch of the lock. In other locks, the plunger is configured to reversibly prevent the movement of a separate bolt or latch. In either case, the plunger performs a linear movement or rotation under the influence of electromagnetic forces and elastic elements.

Electronic locks in general are widely known and used as locking mechanisms in doors, windows, boxes, cases, drawers, safes, padlocks, bicycle locks, etc. Some electronic locks have a keypad control panel near the door or on the door itself, which is used to input an entry code. Other types have magnetic card readers for input of the entry code, as used in hotels and some condominiums. Yet others have sophisticated receivers and may be operated remotely, for example door locks of cars.

There are attempts to combine the advantages of the electronic locks and the mechanical locks, especially when retrofitting existing doors with new electronic locks. US Pat. Application Publication 2001/0027671 discloses a system comprising electronic. cylinders and electronic keys. The electronic cylinder has no power supply but has a built-in microprocessor and memory chip and electric contacts in a recess accepting the key bit. The electronic key contains a battery to operate the cylinder, and a microprocessor with memory. The key serves also as a handle to turn the cylinder in the lock and to open the lock bolt.

WO 99/61728 discloses an electronic cylinder lock comprising an inner and an outer cylinder plug, a battery, a servo actuator, a control unit, and a mechanical clutch. The servo actuator and the clutch are disposed in the cylinder between the plugs, in a rotary cam engaged with the locking bolt. An electronic key for this lock is described in WO 97/48867. The coded signal is transmitted via electric contacts in the key bit and in a recess in the cylinder plugs. Normally, neither cylinder plug is engaged to the rotary cam. When a key is inserted in one of the plugs and the coded signal is recognized, the servo actuator operates the clutch and connects the plug to the rotary cam.

U.S. Pat. No. 6,411,195 discloses a data transmission system including a data transmitting device having a reciprocable impact head for delivering an encoded series of mechanical impacts to a first surface of an impact transmissive body such as a door, and a data receiving device having a sensitive microphone at a second surface of the impact transmissive body for picking up vibrations resulting from the series of impacts. The data transmission system is suitable for use in coded access systems.

U.S. Pat. No. 6,865,916 discloses a cylinder lock for use in a door lock, comprising an outer plug, an inner plug, a rotary cam adapted to move a deadbolt of the door lock, and a clutch adapted to engage for rotation the outer plug to the rotary cam. The cylinder lock further comprises an electronic blocking device (EBD) and a drive adapted to actuate the clutch upon an unblocking command from the EBD generated upon receiving therein an unblocking signal emitted from the outer side of the door, thereby enabling moving the deadbolt by rotation of the outer plug. The cylinder lock comprises an inner handle attached thereto at the inner side of the door, the EBD and the drive being entirely accommodated within the inner handle. The signal is emitted by an electronic key or panel and may be a mechanical vibration signal, a light signal, or a radio signal.

US Pat. Application Publication No. 2006/0179903 discloses a mechanism for an electromechanical lock. The mechanism comprises a shackle or strike moveable in a bore. A cam is rotatable between a first cam position in which movement of the shackle or strike in the bore is prevented and a second cam position in which movement of the shackle or strike in the bore is not prevented. A blocking pin is moveable between a first pin position in which rotation of the cam is prevented and a second position in which rotation of the cam is not prevented. A solenoid has a plunger having a stable extended position in which movement of the blocking pin is prevented and a stable retracted position in which movement of the blocking pin is not prevented.

While each of the above constructions has its advantages, it is desirable to avoid some deficiencies such as exposure to tampering or malevolent damage, etc.

GENERAL DESCRIPTION OF THE INVENTION

The present invention concerns a novel electromagnetic lock with improvements in the electromechanical mechanism operating within the lock. The electromechanical lock of the invention comprises an electric actuator, for example a bistable latch solenoid and a locking assembly driven by the actuator for locking and unlocking the lock. One of the characterizing features of some embodiments of the invention resides in some urging arrangements operative to ensure reliability of switching between different states of the lock including a locking and an unlocking state. This urging arrangement provides for a sufficiently strong bias of components of the locking assembly to ensure switching into the locking state upon such actuation by the actuator and a reverse bias upon opposite actuation by the actuator. Furthermore, the urging arrangement according to some embodiments of the invention also guards against accidental switching between different lock states.

The present invention provides, by one of its embodiments, an electromechanical lock, comprising: a locking assembly and solenoid with a plunger axially displaceable, by an electrical command signal, between retracted and extended states and being associated with a first urging arrangement, biasing the plunger in a first axial direction from the retracted to the extended states; the locking assembly comprising a lock actuation member movable between first and second states for locking and unlocking the lock, respectively, a second urging arrangement operative to bias said actuation member to move to the second state and comprising a third urging arrangement operative to bias the actuation member to move from the second to the first state; the plunger being operatively associated with the locking assembly to cause said lock actuation member to move from the first to the second state for unlocking the lock upon displacement of the plunger in the first direction, and to permit movement of the actuation member, induced by the third urging arrangement, from the second to the first state for locking the lock, upon displacement of the plunger from the extended to the retraced state.

The term "urging arrangement" relates to an assembly of one or more urging devices or elastic elements operative to impart the recited action. An urging arrangement may include one or more springs, spring-comprising urging devices (for example a two-component telescopic device with incorporating a biasing helical spring), a pneumatic urging device, and others. While according to some embodiments the urging arrangement includes one urging device, e.g. one spring, according to some other embodiments the urging arrangement includes two or more urging devices, e.g. two or more springs, operating in tandem to impart a bias.

The term "movable" should be understood as encompassing the ability to be displaced, to change in position or orientation or a combination of the following. A specific type of movement of components during operation of the lock according to some embodiments of the invention, albeit not exclusive, is displacement, for example linear displacement, in a path provided for it with the housing of the lock. However other type of movements of components of the invention, for example angular movement, is also contemplated in accordance with some other embodiments of the invention.

According to an embodiment of the invention the biasing force of the first urging arrangement in its tensioned state (e.g. compressed state where the urging arrangement is a spring) is greater than that of the second urging arrangement and the biasing force of the second urging arrangement in its tensioned state (e.g. compressed state where the urging arrangement is a spring) is greater than that of the third urging arrangement.

The solenoid operative in the lock of the invention is typically a bi-stable latch solenoid. Upon an appropriate electrical command signal typically from electric control mechanism included within the lock and responsive to an appropriate axis control signal, through the combined force as a result in the change in the magnetic field and the biasing force of the first urging arrangement, the plunger switches axially from the retracted to the extended state. This then causes the second urging arrangement to exert biasing force on the lock actuation member to move from the first to the second state to switch the lock into a locked state. The lock typically has a timing mechanism and after a predetermined time period, or in case no such timing mechanism is operative, upon issuing of a closure signal, electric command signal to the solenoid gives rise to a magnetic biasing force operative against the biasing force of the first urging arrangement to switch the solenoid from the extended back to its retracted state. The third urging arrangement then becomes operative to induce the lock actuation member to switch back to its first state thereby switching the lock from its unlocked to its locked state.

In accordance with one embodiment of the invention the second urging arrangement is disposed such that upon displacement of the plunger from the retracted to the extended state, mechanical energy is transferred to the second urging arrangement which then in turn employs this energy to bias the locked actuation member into said second state. In this embodiment the said second urging arrangement is functionally disposed between the plunger and the low actuation member. In some embodiments of the invention the lock comprises an auxiliary actuation member which is functionally disposed between the plunger and the second urging arrangement. Thus, upon displacement of the plunger into the retracted state, the plunger engages said auxiliary actuation member and causes it to move whereby the auxiliary actuation member transfers energy to the second urging arrangement which then it turn biases the movement of the lock actuation member from the first to the second state.

In accordance with some embodiments of the invention, the movement of the different component is essentially axial, namely, essentially parallel to the direction of displacement of the plunger. The lock in accordance with this embodiment comprises: a locking assembly and a solenoid with a plunger axially displaceable, by an electrical command signal, between retracted and extended states and being associated with a first urging arrangement, biasing the plunger in a first axial direction from the retracted and extended states; the locking assembly comprising a sliding lock actuation member movable through axial displacement between locking and unlocking states for locking and unlocking the lock, respectively, a second urging arrangement operative to axially bias said actuation member to displace in said first direction and comprising a third urging arrangement operative to bias said actuation member to move by displacement in a second direction opposite said first direction; the plunger being operatively associated with the locking assembly to cause said lock actuation member to axially displace from the first to the second state for unlocking the lock upon displacement of the plunger from the retracted to the extended state, and to permit axial displacement of the actuation member, induced by the third urging arrangement, from the second to the first state for locking the lock upon displacement of the plunger from the extended to the retracted state.

According to one embodiment the lock is a rotary lock intended for installing in doors. Such rotary locks typically comprise a rotary cam which engages directly or through an intermediate mechanism with the door's dead bolt. In accordance with some embodiments of the invention, the lock comprises a first rotary assembly, housing and a rotary cam for opening and closing the lock. The first rotary assembly is disengaged from the rotary cam in the first state of the lock actuation member. Displacement of the lock actuation member into the second state causes rotational engagement of the first rotary assembly with the rotary cam. The first rotary assembly is typically fixed at the door's exterior and fitted with a door handle or the like. Mechanism or engagement of a rotary assembly to permit opening of a door in an unlocked state of a lock, and disengagement in a locked state are known per se, for example, in U.S. Pat. No. 6,865,916 the contents of which are incorporated herein by reference.

The lock according to some embodiments comprises also a second rotary assembly which is in a fixed engagement with said rotary cam. Such a second rotary assembly may typically be fixed to the door's interior to permit opening and closing the door from the interior at all times. For security reasons, the solenoid driven mechanism may be comprised in the second rotary assembly, e.g. in the door's interior; albeit in some embodiments the mechanism is comprised within the first rotary assembly.

In accordance with other embodiments of the invention, the lock comprises a locking latch which can be displaced between two states—a disengaged and an engaged state corresponding to the locked and unlocked states of the lock, respectively. The displacement of the lock actuation member in the second position yields a path that permits the displacement of the locking latch from disengaged to an engaged state to unlock the lock.

BRIEF DESCRIPTION OF THE DRAWINGS

In order to understand the invention and to see how it may be carried out in practice, embodiments will now be described, by way of non-limiting example only, with reference to the accompanying drawings, in which.

DETAILED DESCRIPTION OF SPECIFIC EMBODIMENTS

In the following description the invention will be illustrated with reference to some specific embodiments shown in the annexed drawings. As will be appreciated, the specific description is illustrative and not limiting.

Reference is first being made to FIGS. 1A-1E showing a door cylinder lock in accordance with an embodiment of the present invention.

Figure 1A:
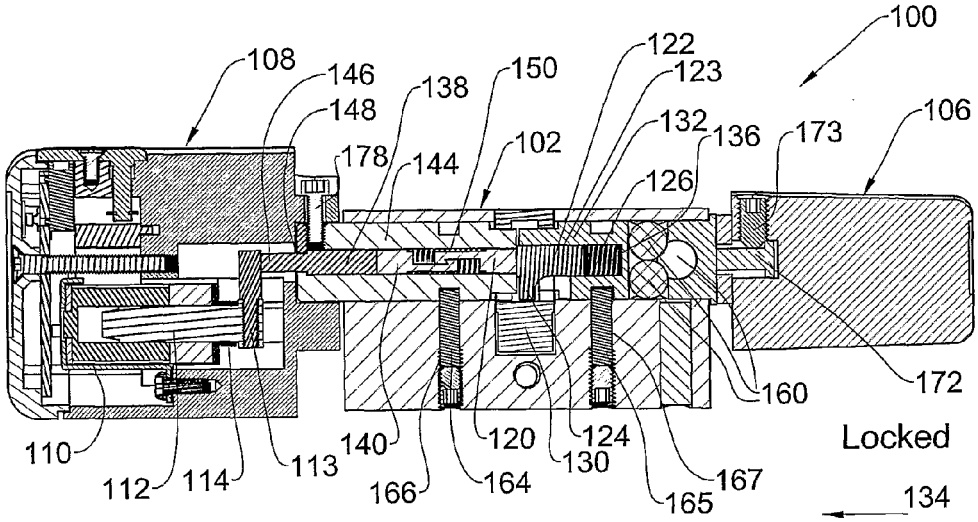
FIGS. 1A-1C show longitudinal cross-sections through a door cylinder lock in accordance with an embodiment of the invention in a locked stated (FIG. 1A), in an intermediate state (FIG. 1B) and in a unlocked state (FIG. 1C).
Figure 1B:
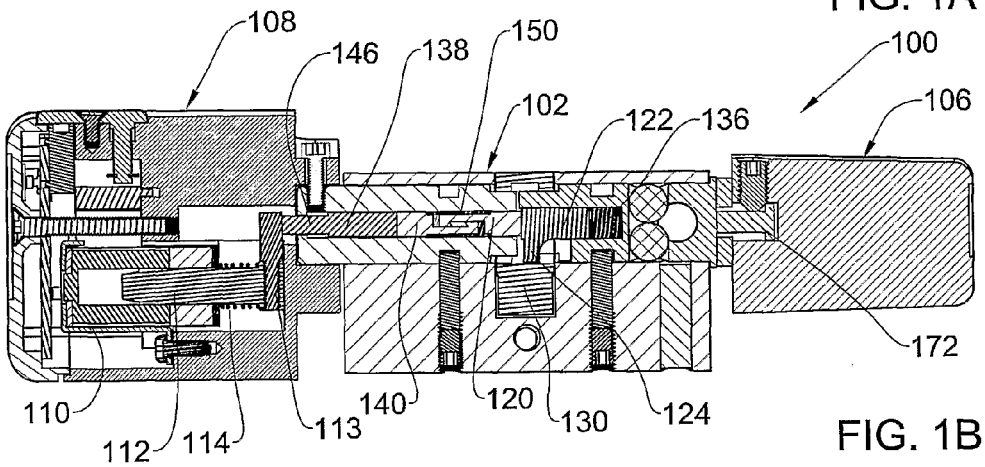
Figure 1C:
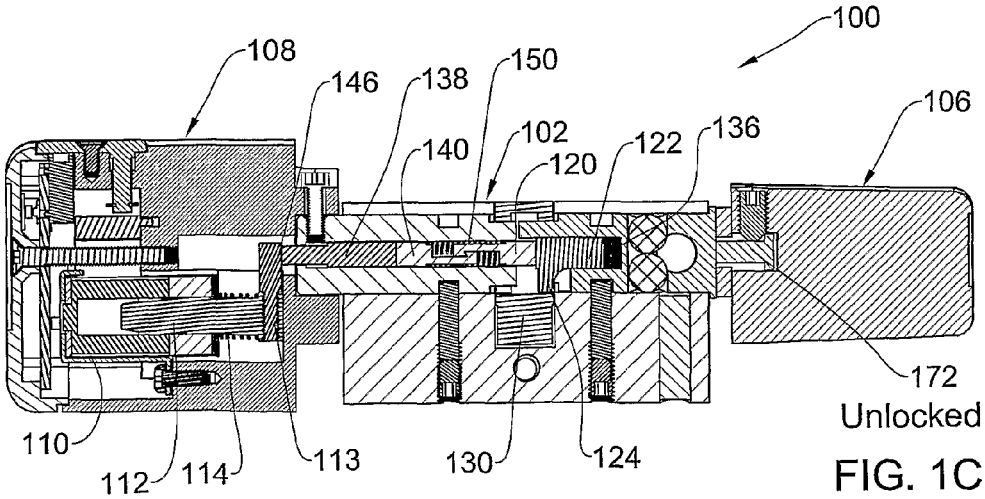

FIGS. 1A-1C are longitudinal cross-sections showing the lock in three operative states: locked state (FIG. 1A), intermediate state (FIG. 1B), and an unlocked state (FIG. 1C). The lock 100 shown in FIGS. 1A-1C has a housing 102 accommodated within the door and has a first rotating handle assembly 106 at the door's exterior and a second rotating handle assembly 108 at the door's interior.

The electromagnetic lock 100 includes a bi stable latch solenoid driven mechanism which is operative to switch the lock between the different states and comprises a solenoid 110 with a plunger 112, associated with a first urging spring 114 and which is axially displaceable between the retracted state of the solenoid shown in FIG. 1A to the extended state shown in FIGS. 1B and 1C. Plunger 112 has a laterally protruding extension 113, for the purpose described further below. The spring 114 exerts a biasing force on the plunger for displacing the plunger from the retracted to the extended state.

Figure 1D:
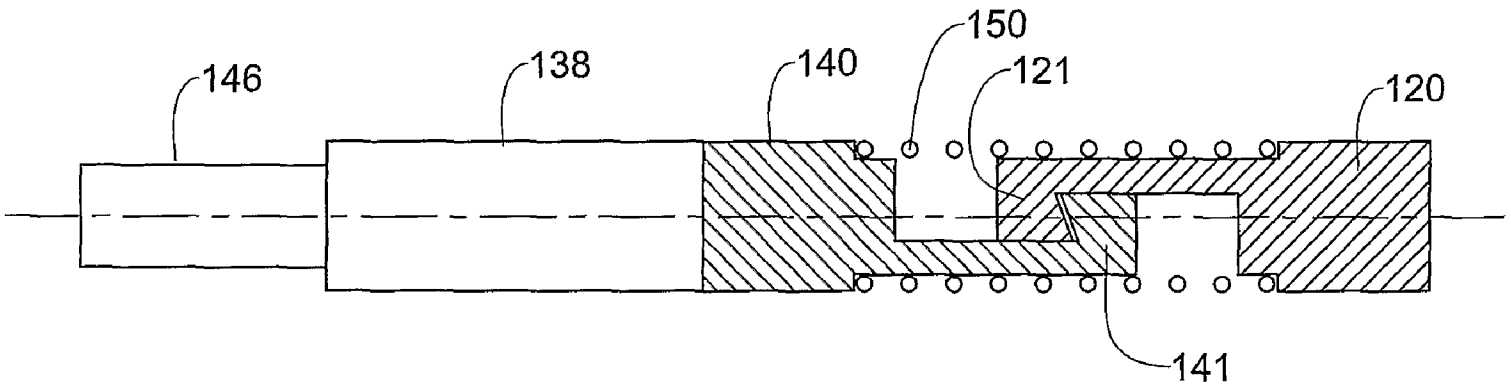
FIG. 1D is an enlarged cross-sectional view of the lock actuation member, the second urging spring and the two elements constituting the auxiliary actuation member.
Figure 1E:
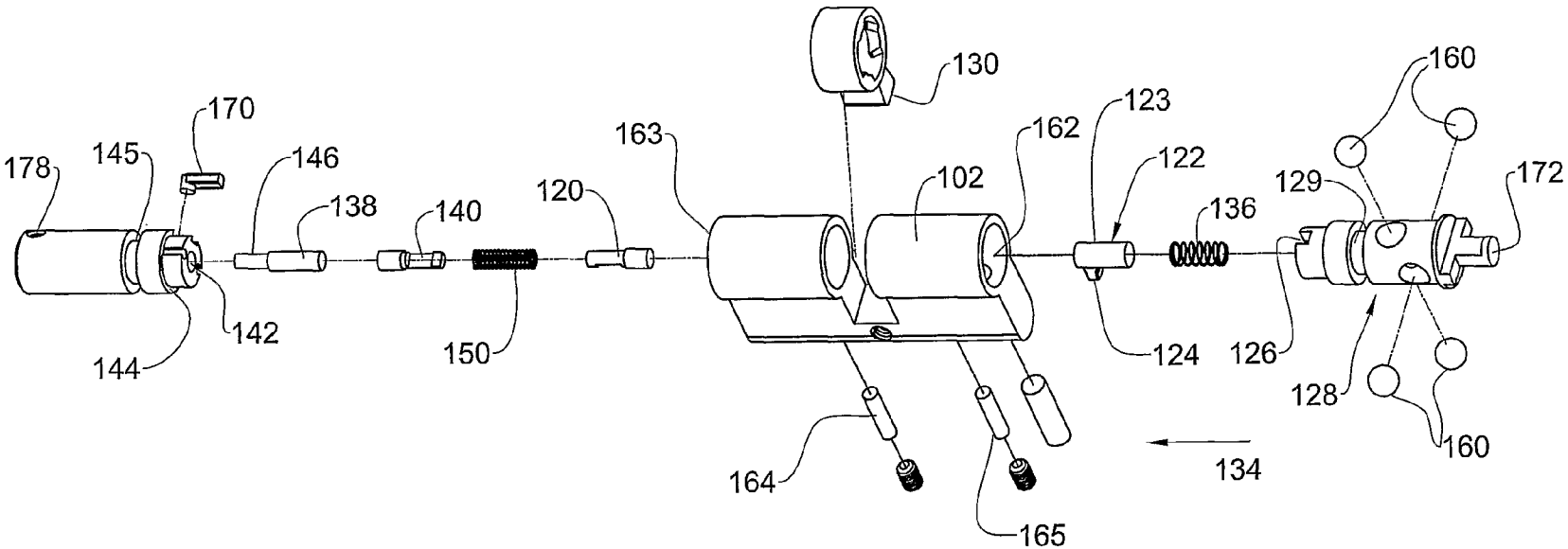
FIG. 1E is an exploded view of the cylinder lock of FIGS. 1A-1C.

The lock includes a locking assembly, which can best be seen in FIG. 1E, and includes a lock actuation unit including a distal lock actuation element 120 and a proximal lock actuation element 122 (with respect to the solenoid assembly). Actuation element 122 includes a protrusion 124 which is accommodated within a groove 126 of a rotating cylinder 128 and which is also adapted for engagement with a rotating cam 130 whereupon such engagement cylinder 128 is rotationally coupled to cam 130. Element 122 has a cylindrical body 123 which is fitted within plug 128 and is axially biased in the direction shown by arrow 134 by a third urging spring 136.

The locking assembly also includes an auxiliary urging unit formed by a proximal element 138 and a distal one 140. Element 138 fits within cylindrical lumen 142 of plug 144 and has a proximal portion 146 protruding out through opening 148 into the handle assembly 108.

Element 140 and element 120 are engaged with one another in a manner best seen in FIG. 1D. Each of elements 120 and 140 has a respective hook portion 121 and 141 which are symmetrically identical and are thus adapted for engagement with one another in the manner shown whereby their disengagement from one another is avoided. However, as can be appreciated, such engagement permits movement of the two elements 120, 140, one towards the other.

Hook portions 121 and 141 have a smaller diameter than the main body of elements 120 and 140 whereby a cylindrical circumferential recess is defined accommodating a second urging spring 150. Second urging spring biases the two elements away from one another.

As can further be seen particularly in FIG. 1E, plug 128 is fitted with ball bearings 160 to permit unhindered rotation of plug 128 within cylindrical lumen 162 of housing 102. Plugs 128 and 144 have respective annular grooves 129 and 145. Pins 164 and 165, which are accommodated within respective bores 166 and 167, engage with said annular recesses 129 and 145 to fix plug 128 within lumen 162 and plug 144 within lumen 163.

Plug 144 is fitted with an engaging element 170 which provides for fixed rotational engagement between plug 144 and rotary cam 130.

Plug 128 has an axial protruding element 172 fitting with a recess in handle 106 and fixed through screw 173. Plug 144 has a rear portion 176 to which handle assembly 108 is fitted and fixed through screw 178.

Handle assembly 108 also includes a battery and an electric control circuitry, of the general kind known per se, such as that described in U.S. Pat. No. 6,865,916, the content of which is incorporated herein by reference.

In the locked state of cylinder lock shown in FIG. 1A, first urging spring 114 is compressed, second urging spring 150 is relatively relaxed and so is third urging spring 136. Upon axial displacement of the plunger, as a result of the approximate electric command issued to bi-stable latch solenoid 110, extension 113 causes axial displacement of elements 138 and 140 towards element 120 giving rise to compression of second urging spring 150, into a state as seen in FIG. 1B. The tension energy which is stored in second urging spring 150 causes, in a subsequent step seen in FIG. 1C, the second spring 150 to axially displace elements 120 and 122 in the same axial direction of the displaced plunger 112, and consequently, notch 124 being initially in a state in which it is rotationally disengaged from rotary cam 130, comes into rotary engagement thus yielding a rotational coupling between handle assembly 106 and rotary cam 130 permitting opening of the door from the outside.

The lock control mechanism is typically programmed to automatic locking after a defined period of time, e.g. 5-10 seconds. Alternatively, this may be through a specific unlocking user inflicting manual command. Upon the appropriate electric signal to solenoid 110, plunger 112 axially moves in the opposite direction from its extended state shown in FIG. 1C into its retracted state as shown in FIG. 1A. In this state, third urging spring 136, compressed while the lock is in the state of FIG. 1C, can extend moving the lock actuation unit, including elements 124 and 120, axially into the locked state as seen in FIG. 1A.

The rotational engagement between plug 128 and rotary cam 130 depends on exact rotational alignment; an intermediate state in which the second urging spring 150 is compressed permits it to store the displacement energy until the proper rotational alignment is achieved whereupon the lock can switch into its locked state.

According to an embodiment of the present invention, the relative strength of the urging springs 114, 150 and 136 is selected so that in the absence of any magnetic force the force of the uncompressed urging spring 114 is greater than the force of the urging spring 150 in its compressed state. The urging spring 150 in its uncompressed state is greater than the strength of the urging spring 136 in its compressed state.

Figure 2A:
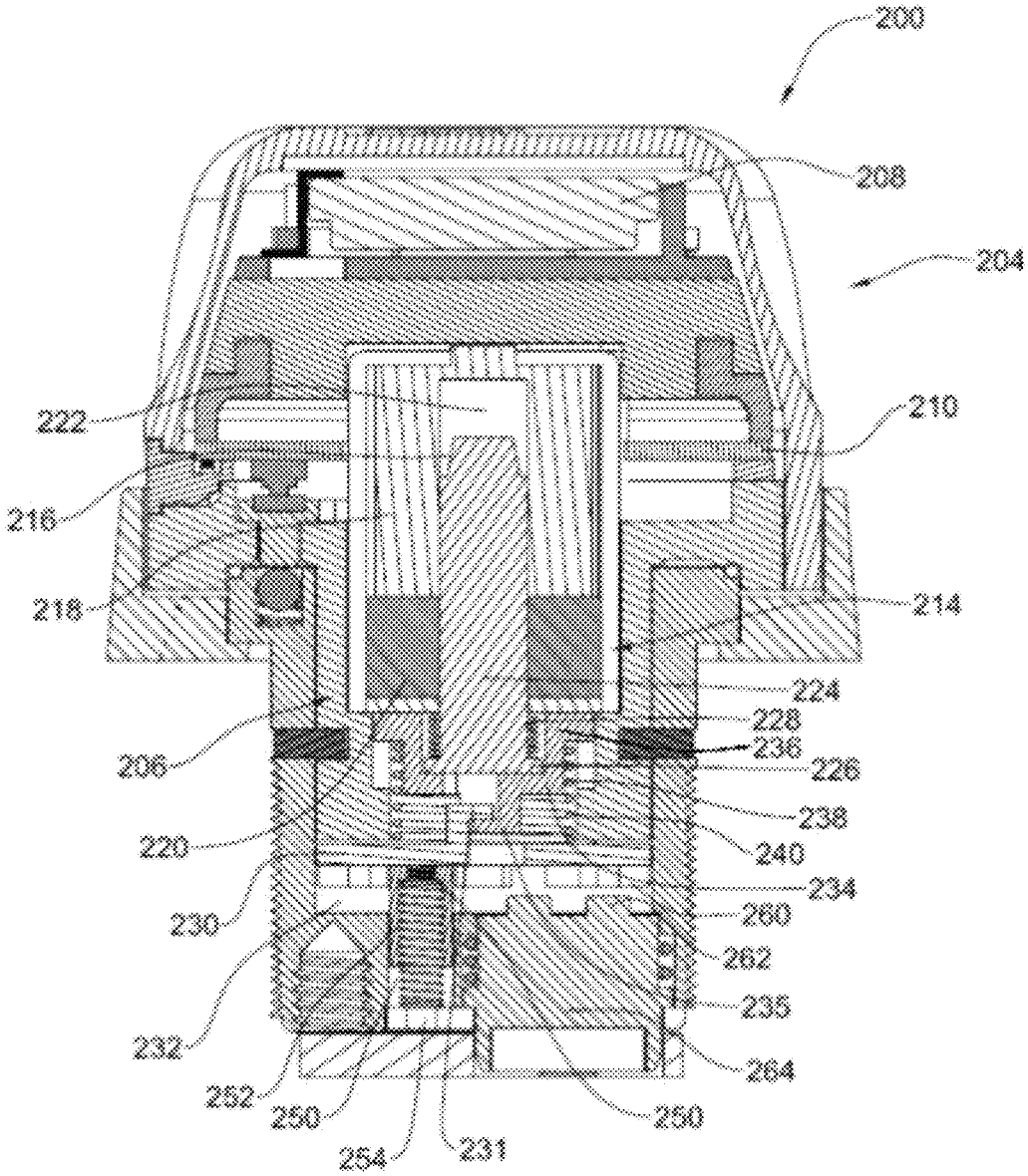
FIGS. 2A-2C are cross-sectional views of a cylinder lock in accordance with another embodiment of the invention in a locked state (FIG. 2A), intermediate state (FIG. 2B) and an unlocked state (FIG. 2C).
Figure 2B:
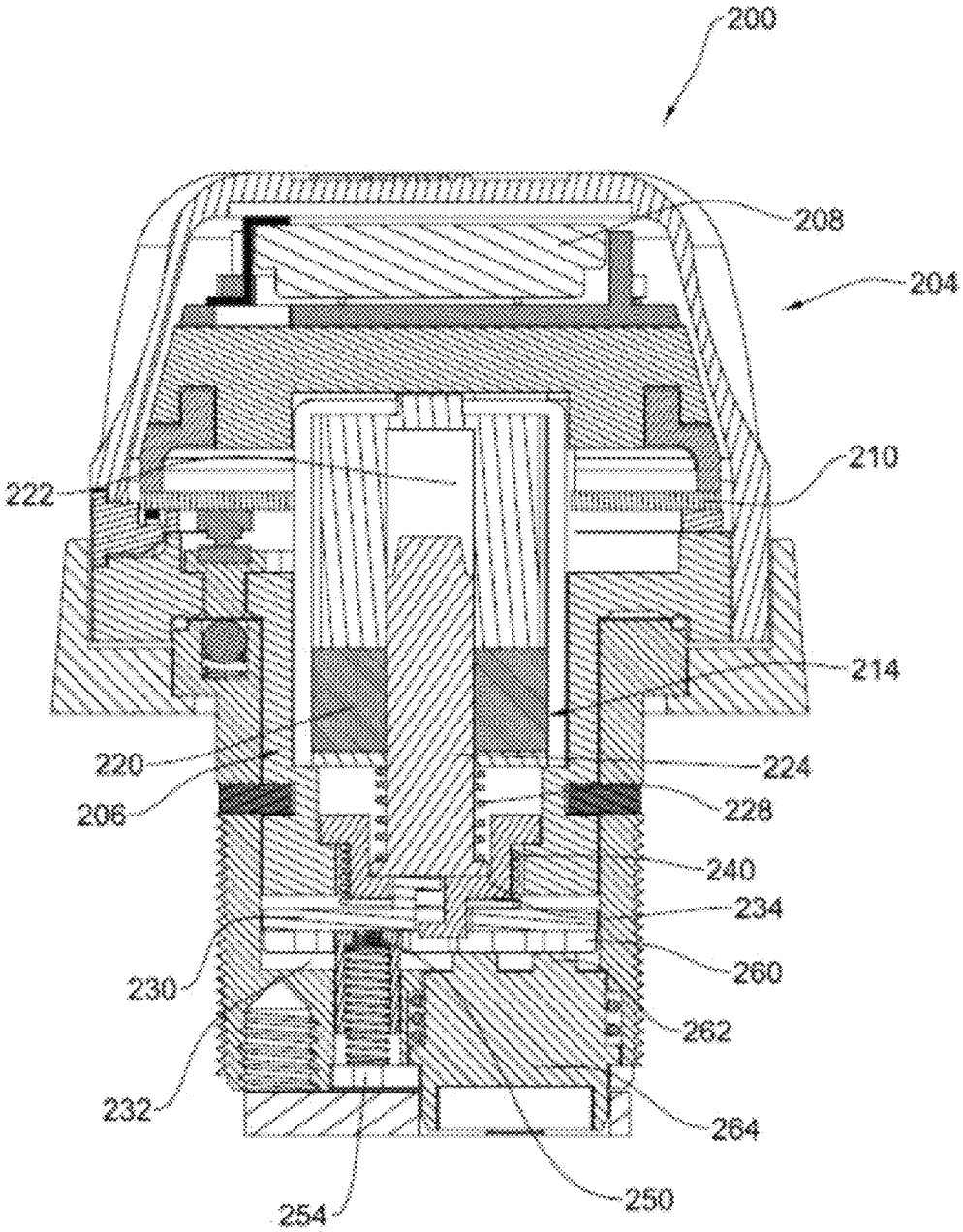
Figure 2C:
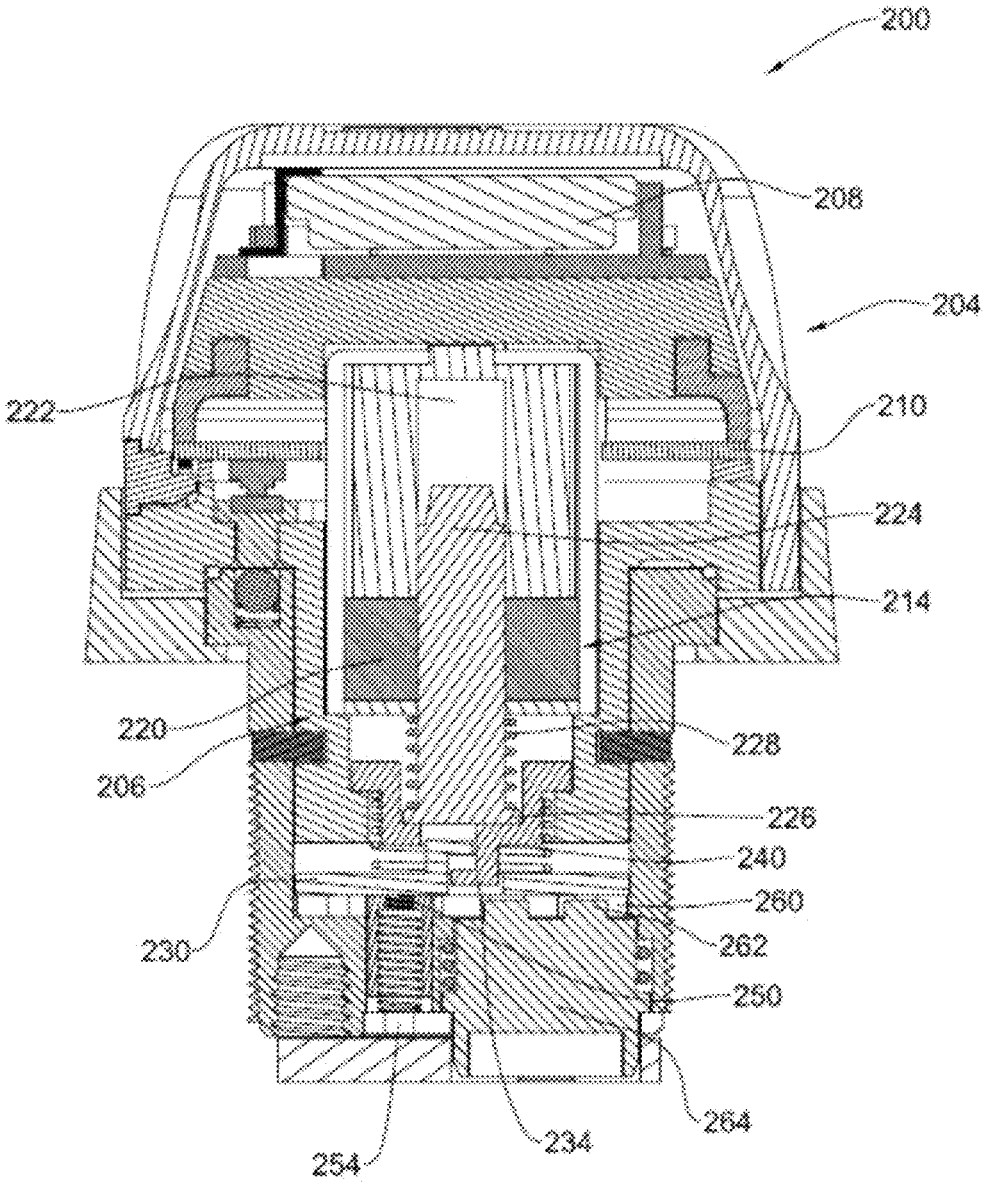
Figure 2D:
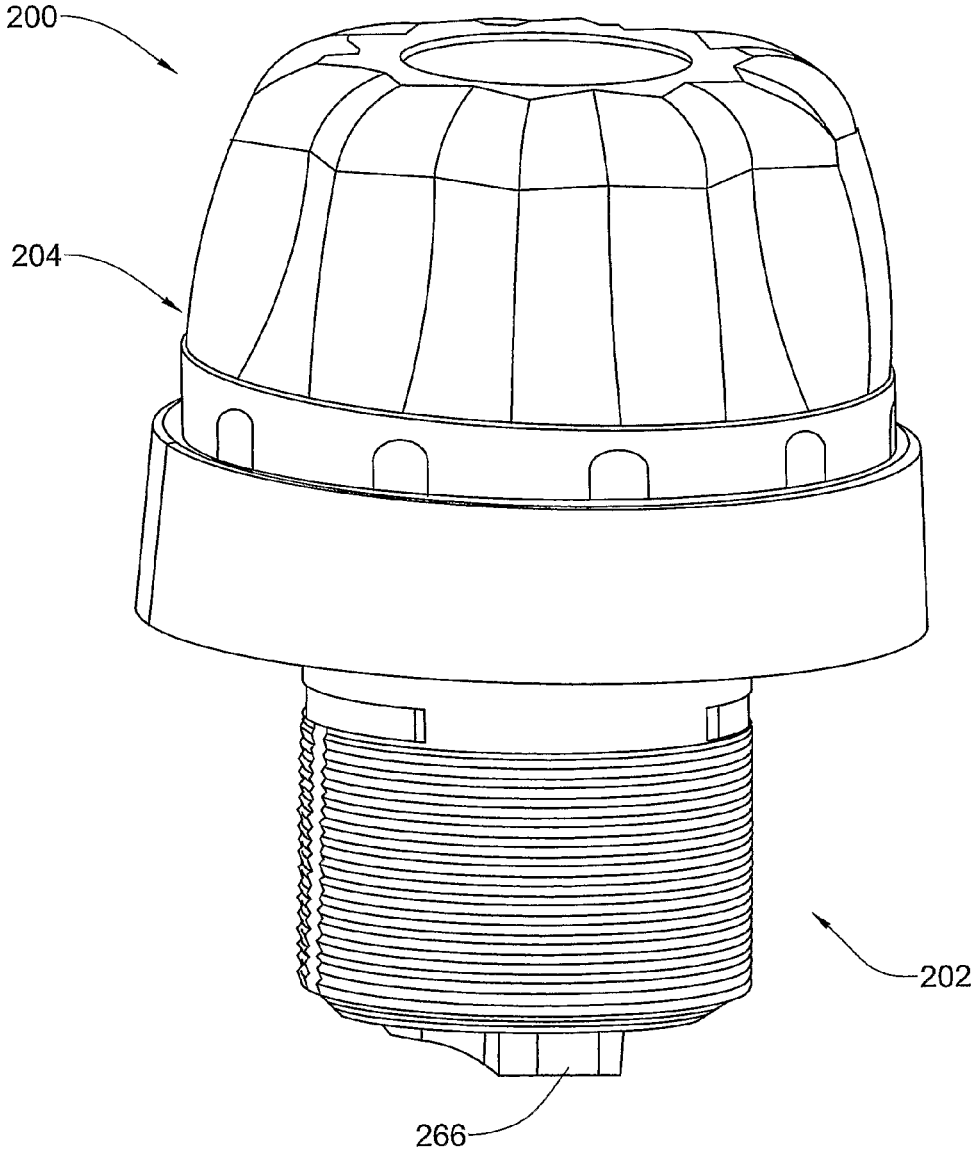
FIG. 2D is an external perspective view of the cylinder lock of FIGS. 2A-2C.

A rotary lock 200 according to another embodiment is seen in FIGS. 2A-2C in a locked state of the lock (FIG. 2A), intermediate state (FIG. 2B) and unlocked state (FIG. 2C). An external prospective view of the cylinder lock can be seen in FIG. 2D).

Cylinder lock 200 has a housing 202 and a rotational handle assembly 204. Handle assembly 204 forms part of a rotational assembly of the lock generally designated 206 rotational within the housing 202.

Handle assembly 204 includes a battery 208, an electronic circuitry board 210 and a lock control mechanism.

Latch solenoid 214 is accommodated within the lock and includes a housing 216, a coil 218 and a fixed magnet 220, all arranged around a cylindrical lumen 222 accommodating a cylindrical plunger 224 with a laterally protruding head 226. The plunger is associated with a first urging spring 228. The solenoid is typically a bi-stable solenoid of the kind disclosed in U.S. Pat. No. 6,865,916. The latch solenoid 214 switches between stables states, including a first, retracted state of the plunger as can be seen in FIG. 2A and a second stable state in which the plunger is extended as can be seen in FIGS. 2B and 2C. The switch between the states is through an appropriate electrical signal issued by an electronic mechanism incorporated within board 210.

Rotational assembly 206 incorporates a locking assembly including a lock actuation member 230, accommodated within space 232 and an auxiliary actuation member 234 having annular shoulders 236 accommodated within recess 238. Members 230 and 234 can axially displace in a path respectively defined by space 232 and recess 238.

Disposed intermediate members 230 and 234 is a second urging spring 240 which imparts a biasing force to force these two members one away from the other. Each of members 230 and 234 has a respective tooth portion 231 and 235 providing for engagement of these two members to avoid their axial disengagement from one another and arranged such so as to permit relative axial displacement of these two members towards one another.

A third urging spring 250 is partially accommodated within a cylindrical lumen 252 and has its end rested against base element 254 fitted to the housing. Third urging spring 250 thus provides an axial biasing force to resist axial displacement of member 230 in a first axial direction corresponding to the axial displacement of the plunger from its retracted to its extended state.

Member 230 has a tooth surface 260 adapted for tooth surface 262 of rotary cam 264, whereupon engagement rotation of rotary assembly 206 causes rotation of rotary cam 264. Rotary cam 264 is engaged with element 266 seen in FIG. 2D, which can then engage the door's dead bolt.

Upon issuing of an activation electric signal, in response to an actuation signal from control mechanism, solenoid 214 is activated to displace the plunger 224 from its retracted state as seen in FIG. 2A, in a first axial direction to the extended state as seen in FIG. 2B. Such displacement also causes corresponding displacement of member 234 causing compression of second spring 240 which thereby gives rise to an axial biasing force on lock actuation member 230 causing its axial displacement against the biasing force of third urging spring 250. The displacement proceeds until the teeth 260 pressed against teeth 262 of rotary cam 264. Upon rotation of rotary assembly teeth 260 and 262 become aligned with respective recesses between teeth 262 and 260 whereby member 230 becomes fully axially displaced into the state as seen in FIG. 2C. In this state rotary handle assembly 206 is rotationally coupled to rotary cam 264, which is the unlocked state of the lock in which rotation of the handle can open the door permitting access.

The mechanism is typically designed such that following a defined period of time, e.g. 5-10 seconds similarly as in the case of the embodiment described above, an opposite actuation signal causes the plunger to displace in an opposite axial direction from its extended to its retracted whereupon the biasing force of the third urging spring 250 can cause axial displacement of the entire lock assembly, consisting of member 230, second urging spring 240 and member 234 in said opposite axial direction to the locked state seen in FIG. 2A.

According to an embodiment of the present invention, the relative strength of the urging springs 228, 240 and 250 is selected so that in the absence of any magnetic force the force of the uncompressed urging spring 228 is greater than the force of the urging spring 240 in its compressed state. The urging spring 240 in its uncompressed state is greater than the strength of the urging spring 250 in its compressed state.

Figure 3A:
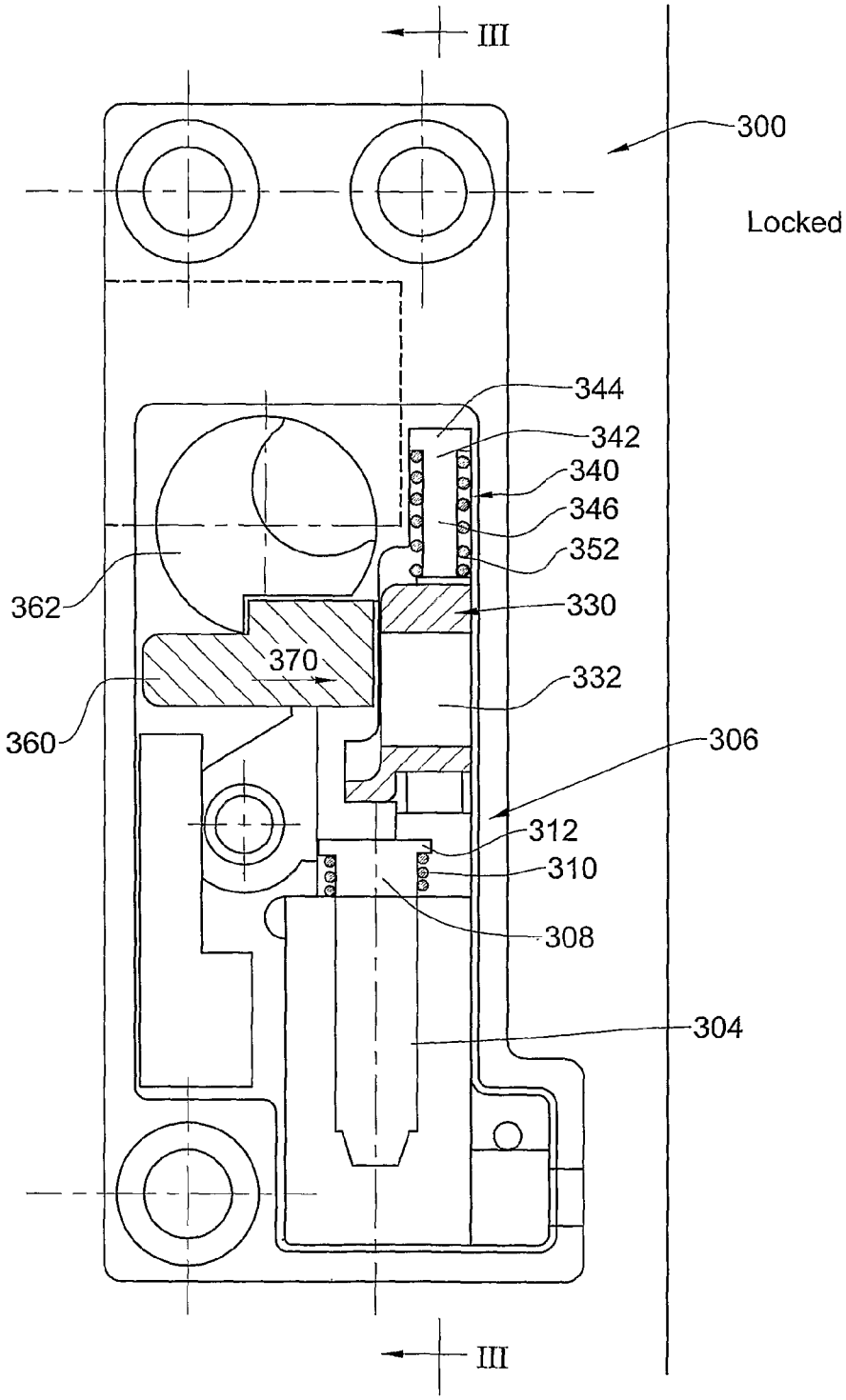
FIGS. 3A and 3B are cross-sectional views of a compartment lock according to an embodiment of the present invention in a locked state (FIG. 3A) and an unlocked state (FIG. 3B).
Figure 3B:
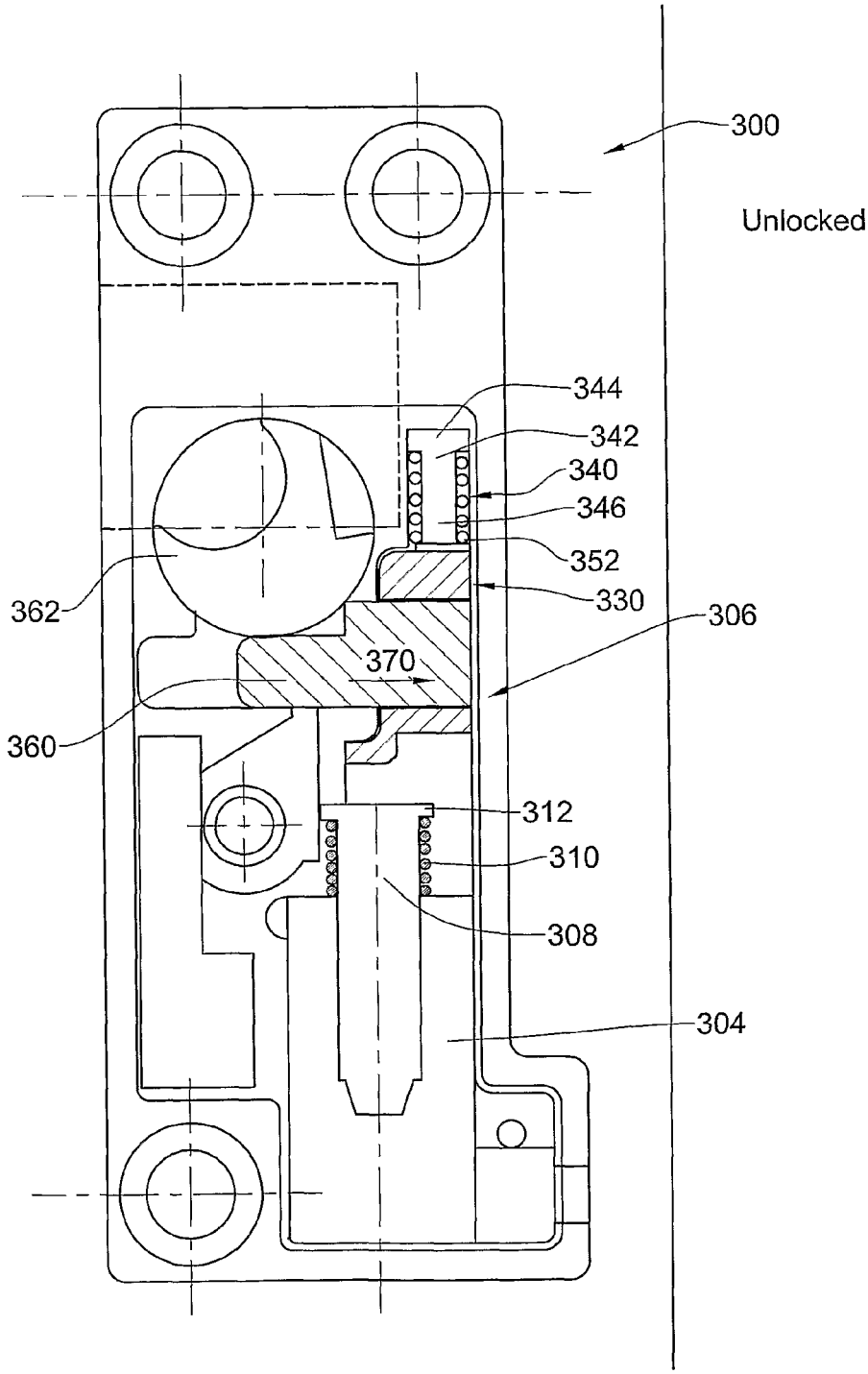
Figure 3C:
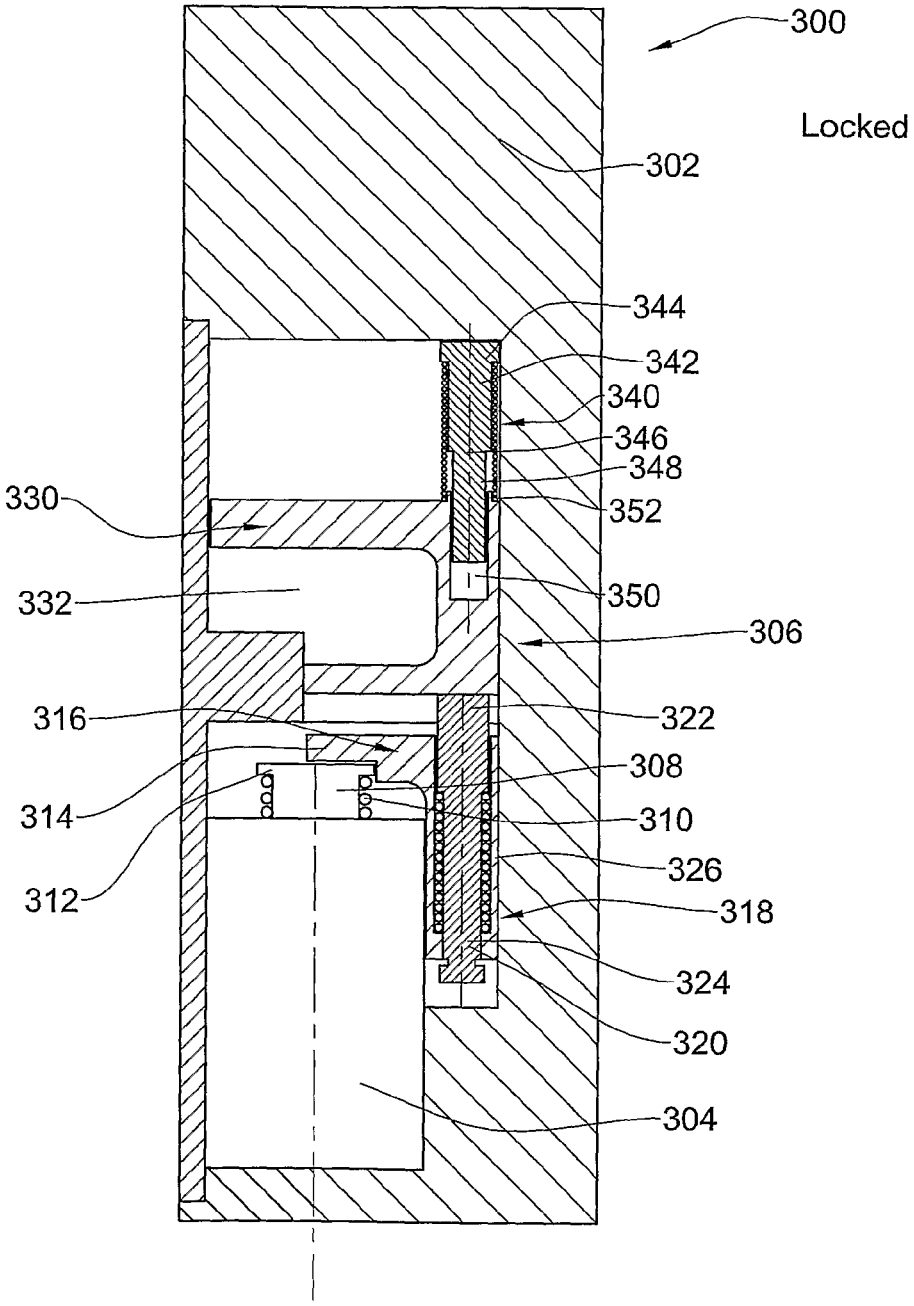
FIG. 3C shows a cross-section through lines III-III in FIGS. 3A.

Reference is now being made to FIGS. 3A-3C concerning a compartment lock according to an embodiment of the present invention. FIGS. 3A and 3B are cross-sectional view in one plane in two different states—a locked state (FIG. 3A) and an unlocked state (FIG. 3B), while FIG. 3C is a cross-section through a plane normal to that of FIG. 3A along lines III-III of FIG. 3A, showing also the lock in its locked state.

The compartment lock 300 has a housing 302 accommodating a bi-stable latch solenoid 304 and a locking mechanism generally designated 306. The solenoid 304 includes a plunger 308 associated with a first urging spring 310. The plunger 310 has a head 312 which bears on shoulder 314 of an auxiliary actuation member 316.

Second urging arrangement generally designated 318 includes a plunger member 320 having a base 322 and an extended stem 324 of a narrow diameter, fitted in a cylindrical bore of auxiliary actuation member 316 with a second helical spring 326 fitted around stem 324 thereby urging plunger 320 and auxiliary actuation member 316 in opposite axial directions.

The base 322 of second plunger 320 bears on a lock actuation member 330 having a through bore 332.

A third urging arrangement generally designated 340 includes a third plunger 342 having a base 344 bearing against the housing, an intermediate slightly narrower portion 346, and a further narrower stem 348 fitting into a bore 350 in actuation member 330. The third urging arrangement also includes a third urging spring 352 bearing at one end at the shoulders formed between intermediate portion 346 and the base 344 and at the other end bears against shoulders defined around the opening of bore 350.

The lock in FIGS. 3A and 3C is shown in its locked state. When the plunger is displaced in a first direction from the retracted state shown in FIGS. 3A and 3C to the extended state shown in FIG. 3B, auxiliary actuation member 316 is displaced against the biasing force of second helical spring 326. This physical energy stored in the second urging member 326 urges displacement of second plunger 320 thereby displacing lock actuation member 330 into the position as shown in FIG. 3A. In this position, locking latch 360, which in the locked state shown in FIG. 3A is locked in position, can in the unlocked state shown in FIG. 3B be displaced within the path defined by bore 332.

Rotary cam 362 which in the locked state blocks the lateral displacement of a strike (not shown) once in the unlocked state of FIG. 3B rotary cam can rotate thus laterally displacing latch 360 in the direction of arrow 370 which is against the biasing force of the biasing arrangement (not shown). When the strike is brought back into position it causes rotation of rotary cam 362 back into the position shown in FIG. 3A whereupon latch 360 comes back into position as a result of the exerted force by its associated urging arrangement (not shown).

The displacement of the lock actuation member 330 into the unlocked state of FIG. 3B is against the biasing force of third urging spring 352. Once the latch 360 returns to its locked state and the plunger returns to its retracted state, the third urging spring can then cause the locking assembly including the lock actuation member 330 the second biasing arrangement 318 and the auxiliary actuation member 316 into its original position in the locked state.

According to an embodiment of the present invention, the relative strength of the urging springs 310, 326 and 352 is selected so that in the absence of any magnetic force the force of the uncompressed spring 310 is greater than the force of the urging spring 326 in its compressed state. The urging spring 326 in its uncompressed state is greater than the strength of the urging spring 352 in its compressed state.

Although the invention is described above with reference to a number of embodiments, it will be apparent to the skilled person that it is not limited thereto and that many adaptations and modifications are possible within the scope of the invention. The scope of the invention is therefore defined solely by the appended claims.

The invention claimed is:

1. An electromechanical lock, comprising:

a latch solenoid driven mechanism comprising a plunger axially displaceable, by a solenoid actuated by an electrical command signal, the displacement being between retracted and extended states and the plunger being associated with a first urging arrangement that biases the plunger in a first axial direction from the retracted to the extended states; and a locking mechanism, comprising:

a lock actuation member movable between first and second states for locking and unlocking the lock, respectively, a second urging arrangement operative to bias said lock actuation member to move to the second state, and a third urging arrangement operative to bias the lock actuation member to move from the second to the first state;

the plunger being operatively associated with the locking mechanism to cause said lock actuation member to move from the first to the second state for shifting the lock to an unlocked state upon displacement of the plunger in the first direction, and to permit movement of the lock actuation member, induced by the third urging arrangement, from the second to the first state for shifting the lock to a locked state, upon displacement of the plunger from the extended to the retracted state, and wherein the biasing force of the first urging arrangement in a tensioned state is greater than the biasing force of the second urging arrangement, and the biasing force of the second urging arrangement in its tensioned state is greater than the biasing force of the third urging arrangement.

2. A lock according to claim 1, wherein said movement of the lock actuation member is in an axial direction.

3. A lock according to claim 1, wherein said second urging arrangement is operative to impact a biasing force on said lock actuation member upon displacement of the plunger from the retracted to the extended state.

4. A lock according to claim 3, wherein the second urging arrangement is functionally disposed intermediate the plunger and said lock actuation member, whereby upon displacement of the plunger from the retracted to the extended state the plunger forces the second urging arrangement which in turn biases the lock actuation member to displace to said second state.

5. A lock according to claim 3, further comprising:

an auxiliary actuation member being operatively disposed for engagement with the plunger for axial displacement of the plunger in the first direction from the retracted to the extended state, the second urging arrangement being functionally associated with said auxiliary actuation member.

6. A lock according to claim 5, wherein upon displacement of the plunger from the retracted to the extended state, the auxiliary actuation member is displaced in the first direction transferring energy to the second urging arrangement which then impacts a bias on said lock actuation member to cause it to displace into said second state.

7. A lock according to claim 1, wherein each of said first, second and third urging arrangements each comprises at least one spring.

8. A lock according to claim 1, wherein the solenoid is a bi-stable solenoid.

9. A lock according to claim 1, wherein the lock switches automatically from the unlocked to the locked state after a defined time period.

10. A lock according to claim 1, being a rotary lock for installing in a door.

11. A lock according to claim 1, wherein the displacement of the lock actuation member to the second state yields a path permitting the displacement of a locking latch from a disengaged to an engaged state to unlock the lock.

12. The lock according to claim 1, wherein said displacement of the plunger is in an axial direction.

13. The lock according to claim 1, wherein said biasing of the first, second, and third urging arrangements is in an axial direction.

* * * * *